US005954544A

United States Patent [19]

Yang

[11] Patent Number: 5,954,544

[45] Date of Patent: Sep. 21, 1999

[54] TWO-PIECE CONNECTOR

[75] Inventor: George Yang, Shih-Lin District, Taiwan

[73] Assignee: All Best Electronics Co., Ltd., Taipei, Taiwan

[21] Appl. No.: 09/015,354

[22] Filed: Jan. 29, 1998

[51] Int. Cl.[6] ..... H01R 17/00

[52] U.S. Cl. ..... 439/660; 439/701

[58] Field of Search ..... 439/660, 79, 80, 439/701

[56] References Cited

U.S. PATENT DOCUMENTS 5,055,069 10/1991 Townsend et al. ..... 439/80

5,453,016 9/1995 Clark et al. ..... 439/80

*Primary Examiner*—Paula Bradley

*Assistant Examiner*—Tho D. Ta

*Attorney, Agent, or Firm*—Pro-TECHTOR International Services

[57] ABSTRACT

Disclosed is a two-piece connector including a plastic body and a top plate. The plastic body is formed of alternately arranged upper and lower pin holes for a plurality of pins to insert into. The upper and the lower pin holes are separated from one another by a separating wall between them. The top plate can be covered and connected to the plastic body by engaging two mortises on the top plate with two tenons on the plastic body. A portion of the top plate extends beyond the plastic body after the top plate is connected to the plastic body. A plurality of ribs are provided on a bottom surface of the portion of the top plate extending beyond the plastic body. Each clearance between two adjacent ribs forms a pin hole corresponding to one of the upper pin holes on the plastic body and forming a continuation of the upper pin hole. Pins can be more easily and accurately inserted into the upper pin holes before the top plate is covered to the plastic body to enhance the production efficiency.

1 Claim, 5 Drawing Sheets

TWO-PIECE CONNECTOR

BACKGROUND OF THE INVENTION

The present invention relates to an improved connector, and more particularly to a two-piece connector with improved pin insertion structure.

FIGS. 1 and 2 are exploded perspective view and assembled side sectional view, respectively, of a conventional one-piece connector. As shown in the figures, the conventional connector includes a plastic body 1 into which a plurality of pins 2 are inserted. The plastic body 1 includes two rows of alternately arranged pin holes 11 and 12. The row of pin holes 11 is located above the row of pin holes 12. A separating wall 13 extends between the rows 11 and 12 and has a length substantially equal to a length of the lower row of pin holes 12. The upper pin holes 11 have a length longer than that of the lower pin holes 12, so that the upper pin holes 11 end at different positions from that of the lower pin holes 12. A top wall 14 horizontally projects from a top face of the plastic body 1 to cover the upper pin holes 11. The top wall 14 prevents the upper pin holes 11 from being too long to firmly hold the pins 2. A portion of the pin holes 11 below the top wall 14 extending beyond the separating wall 13 is downward open, and similarly, a portion of the pin holes 12 below the separating wall 13 extending beyond the plastic body 1 is downward open. The pins 2 are inserted into the upper and lower pinholes 11, 12 with their rear portions located beneath the downward open portions of the pin holes 11, 12 and ended with a downward bend. The downward bent ends of the pins 2 serve as insertion pins for connecting and transmitting signals. Two locating members 15 are separately associated with the bent ends of the pins 2 inserted in the two rows of pin holes 11, 12 to fix positions of the bent ends of the pins 2 relative to one another.

Following drawbacks are found in the above described conventional one-piece connector:

1. The whole one-piece connector is formed from plastic material by injection molding. The upper pin holes 11 are so long that they will cause difficulty in the injection molding. A most common problem with the injection molding of such connector is broken or bent mold needles of the mold corresponding to the long pin holes.
2. The upper pin holes 11 are very long and it is uneasy to accurately insert the pins 2 into their respective pin holes 11. A common condition is that more than one pin 2 is inserted into one pin hole 11 and causes damaged pins 2. As a result, much more time is needed to carefully and accurately insert the pins 2 into the pin holes 11.

SUMMARY OF THE INVENTION

It is therefore a primary object of the present invention to provide a two-piece connector, so that the connector may have upper pin holes with shortened length.

Another object of the present invention is to provide a two-piece connector, so that pins can be more easily inserted into pin holes on the connector to enhance production efficiency.

To achieve the above and other objects, there is provided a two-piece connector including a plastic body, a top plate and a plurality of pins. The plastic body is provided with alternately arranged upper and lower pin holes for the a plurality of pins to insert into. The upper pin holes are separated from the lower pin holes by a separating wall formed on the plastic body between the upper and the lower pin holes. The separating wall is provided on a top surface near two sides thereof with two tenons. The top plate is provided on a bottom surface near two sides thereof with two mortises corresponding to the two tenons on the separating wall for engaging with the tenons and thereby connecting the top plate to the plastic body. The top plate has a portion extending beyond the plastic body when the top plate is covered and connected to the plastic body. A plurality of ribs are provided on a bottom surface of the portion of the top plate extending beyond the plastic body, such that each clearance between two adjacent ribs on the top plate forms a pin hole corresponding to one of the upper pin holes on the plastic body to form a continuation of the pin hole. The pins can be inserted into the upper pin holes before the top plate is covered and connected to the plastic body. Due to the provision of the top plate, the upper pin holes on the two-piece connector may have shortened length to facilitate easy and accurate insertion of the pins into the upper pin holes without adversely affecting the strength of the connector and the pins inserted into the connector. The production efficiency can therefore be enhanced.

BRIEF DESCRIPTION OF THE DRAWINGS

The objects, the features, and the function of the present invention can be best understood by referring to the following detailed description of the preferred embodiment and the accompanying drawings, wherein.

DETAILED DESCRIPTION OF THE PREFERRED EMBODIMENT

Figure 1:
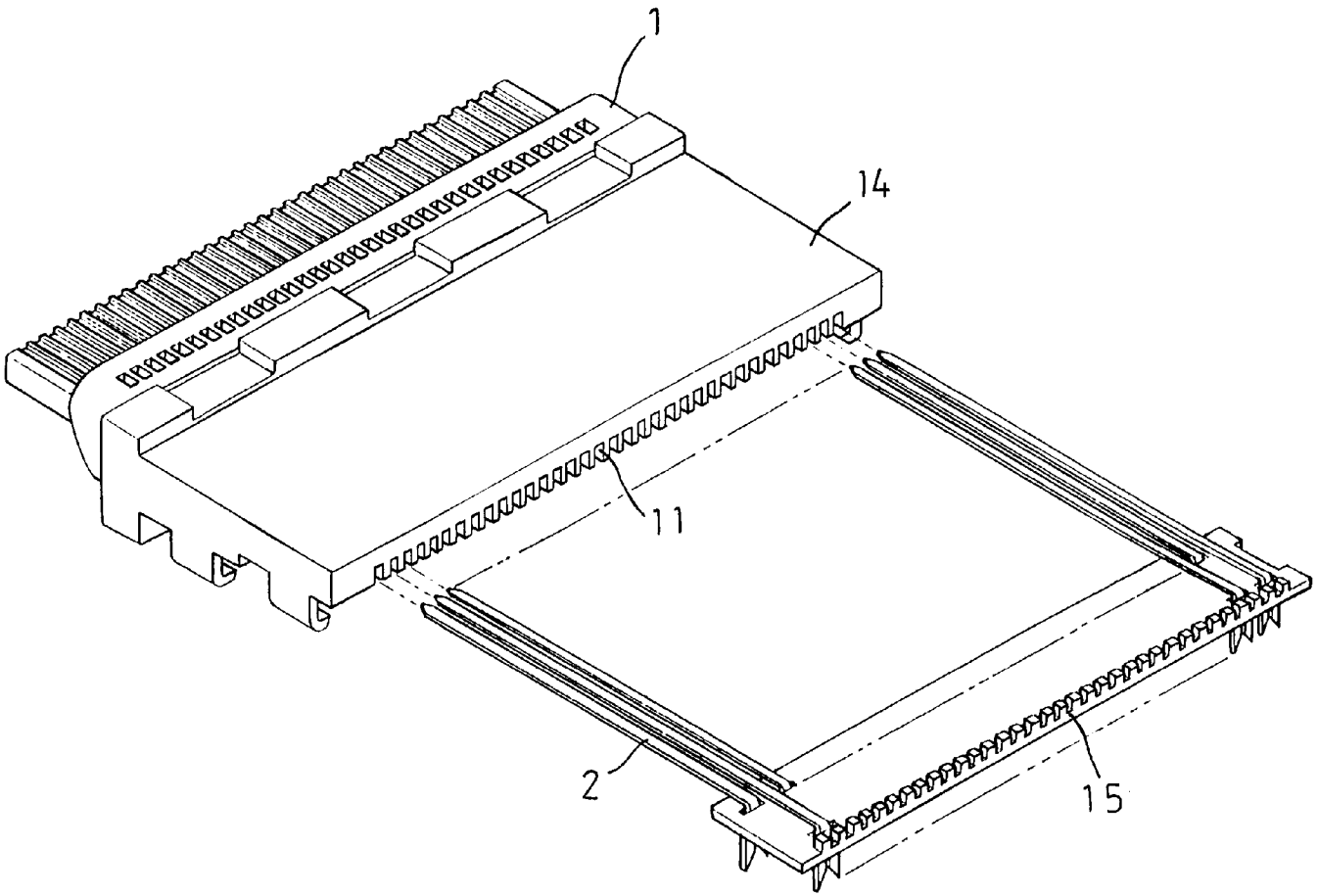
(PRIOR ART) FIG.1
FIG. 1 is an exploded perspective of a conventional one-piece connector.
Figure 2:
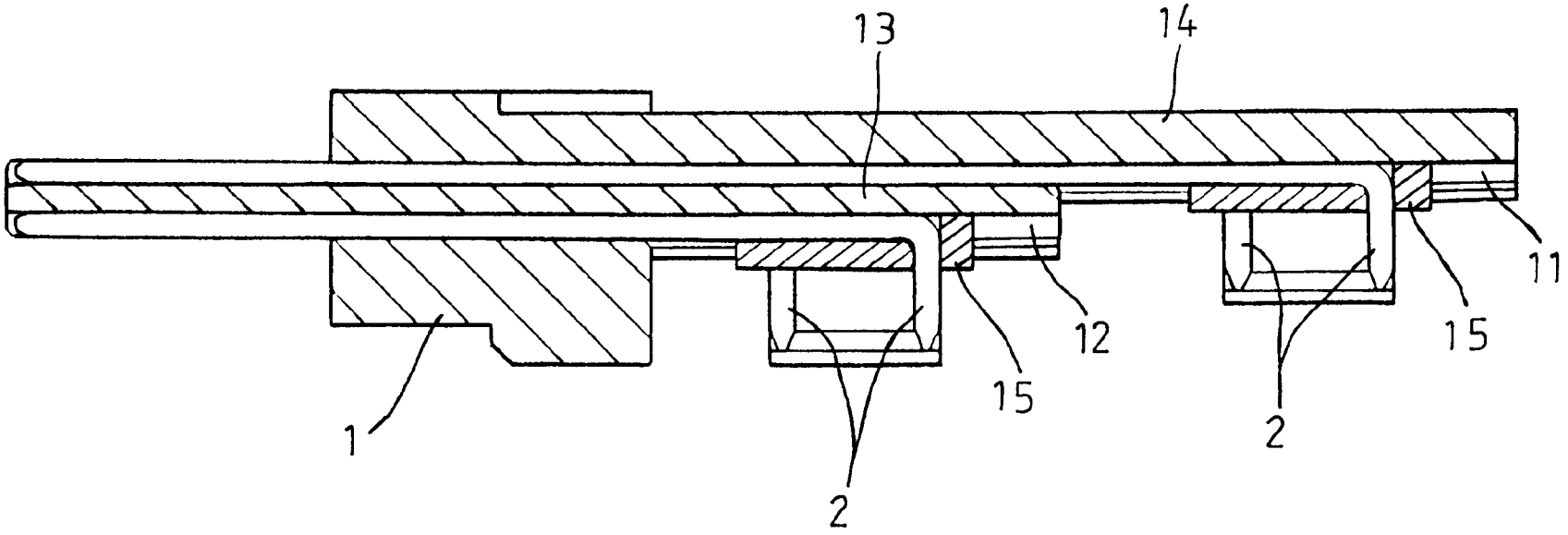
(PRIOR ART) FIG. 2
FIG. 2 is an assembled side sectional view of the connector of FIG. 1.
Figure 3:
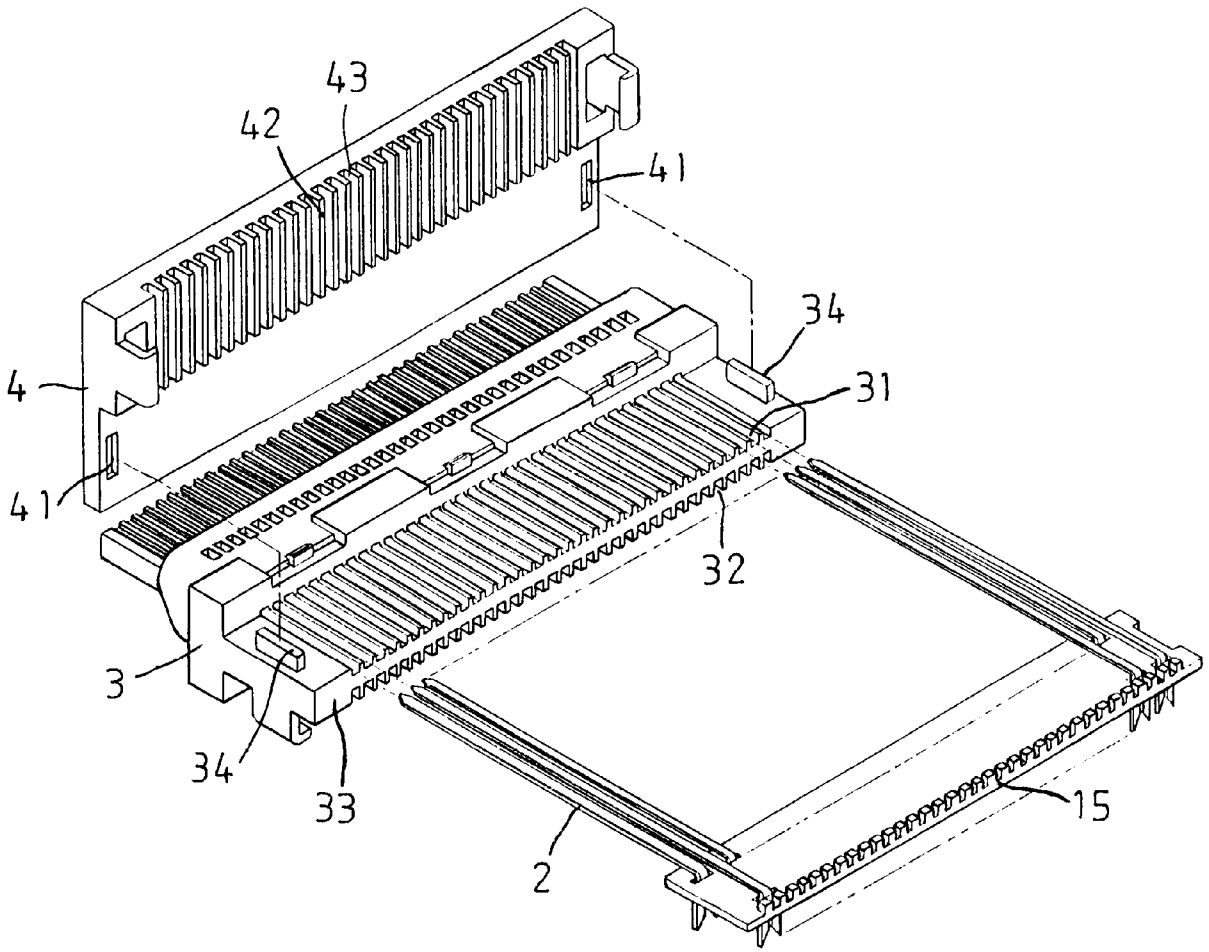
FIG. 3 is an exploded perspective of a two-piece connector according to the present invention.
Figure 4:
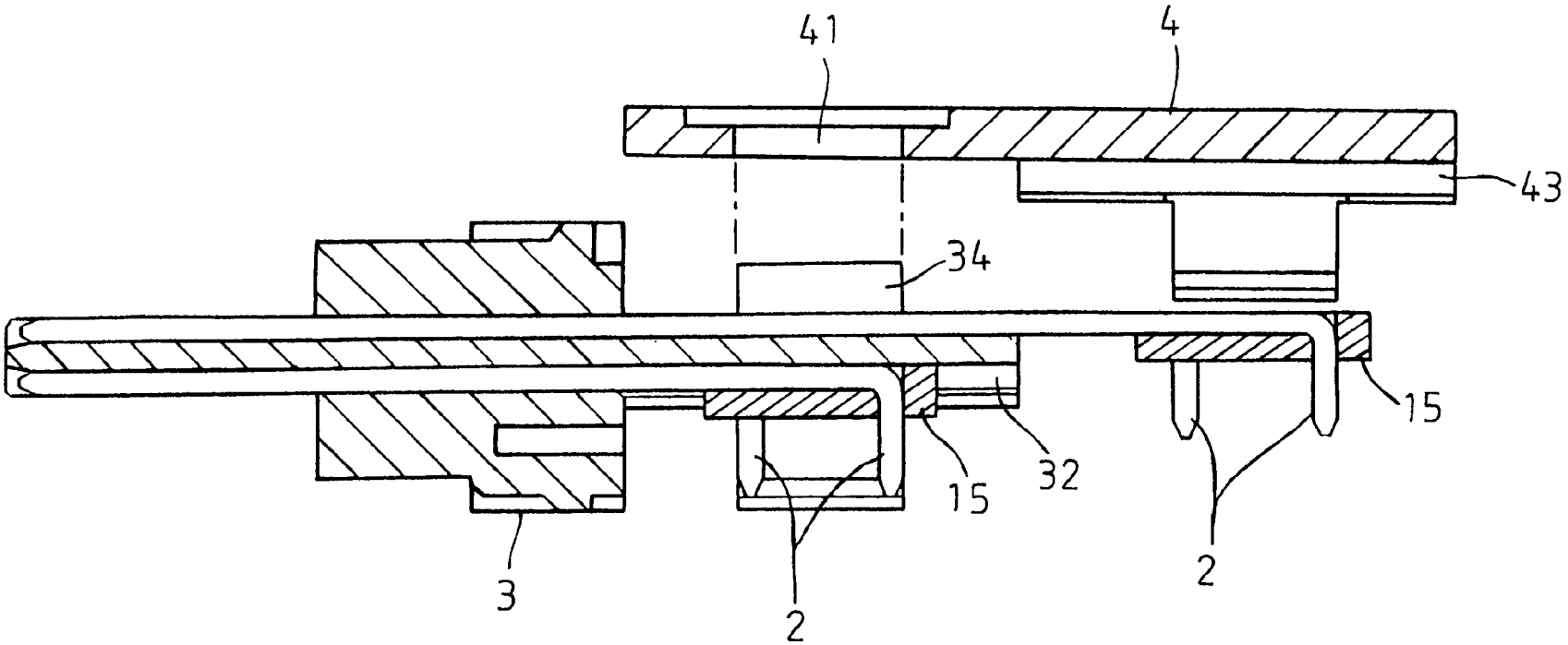
FIG. 4 is an exploded side sectional view of the two-piece connector of the present invention.

Please refer to FIGS. 3 and 4 which are exploded perspective and exploded side sectional view, respectively, of a two-piece connector according to the present invention. As shown in the drawings, the two-piece connector mainly includes a plastic body 3, a top plate 4, and a plurality of pins 2.

The plastic body 3 is provided with alternately arranged upper and lower pin holes 31, 32, respectively. The upper and lower pinholes 31, 32 are separated from one another by a separating wall 33 formed on the plastic body 3 between the upper and the lower pin holes 31, 32. Two outer ends of a top surface of the separating wall 33 are respectively provided with a tenon 34.

The top plate 4 is provided at two sides of a bottom surface with mortises 41 corresponding to the tenons 34 on the plastic body 3. After the top plate 4 is assembled to the plastic body 3 by engaging the mortises 41 with the tenons 34, there is a portion of the top plate 4 extending beyond a front edge of the separating wall 33. A plurality of ribs 42 are parallelly formed on a bottom surface of the portion of the top plate 4 extending beyond the separating wall 33, so that each clearance between two adjacent ribs 42 forms a pin hole 43 corresponding to an upper pin hole 31 on the plastic body 3 and forming a continuation of the upper pin hole 31.

Pins 2 used in the present invention are identical to the pins 2 used in the conventional connectors. And, a locating member 15 similar to that used in the conventional connectors is engaged with bent ends of the pins 2, in order to fix the bent ends of pins 2 in place relative to one another.

Figure 5:
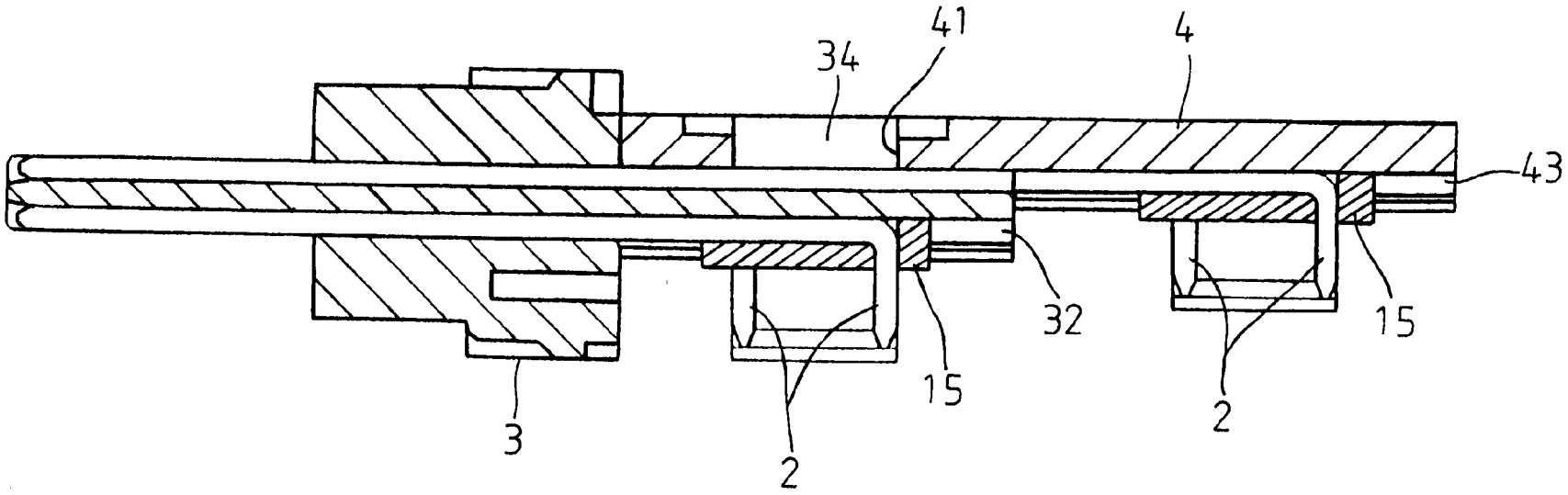
FIG. 5 is an assembled side sectional view of the two-piece connector of the present invention.

Before the top plate 4 is covered on the plastic body 3, pins 2 are first inserted into the upper and lower pin holes 31, 32 formed on the plastic body 3. Then, the top plate 4 is assembled to the plastic body by engaging the mortises 41 on the top plate 41 with the tenons 34 on the separating wall 33, as shown in FIG. 5. By this way, the upper pin holes 31 into which the pins 2 are inserted may have a shortened length without adversely affecting a strength of the pin holes 31 having the pins 2 received therein. Moreover, the shortened upper pin holes 31 allow the pins 2 to be more easily and accurately inserted into the pin holes 31. A high production efficiency can therefore be achieved.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A two-piece connector comprising a plastic body, a top plate, and a plurality of pins; said plastic body being provided with alternately arranged upper and lower pin holes for said pins to insert into, said upper pin holes being separated from said lower pin holes by a separating wall formed on said plastic body between said upper and said lower pin holes; said separating wall being provided on a top surface near two sides thereof with two tenons, said top plate being provided on a bottom surface near two sides thereof with two mortises corresponding to said two tenons on said separating wall for engaging with said tenons and thereby connecting said top plate to said plastic body; said top plate having a portion extending beyond said plastic body when said top plate is covered and connected to said plastic body; and a plurality of ribs being provided on a bottom surface of the portion of said top plate extending beyond said plastic body, such that each clearance between two adjacent ribs on said top plate forms a pin hole corresponding to one of said upper pin holes on said plastic body and forming a continuation of said upper pin hole.

* * * * *